US011408275B2

(12) United States Patent
Jabari et al.

(10) Patent No.: US 11,408,275 B2
(45) Date of Patent: Aug. 9, 2022

(54) DOWNHOLE PLUGS INCLUDING A SENSOR, HYDROCARBON WELLS INCLUDING THE DOWNHOLE PLUGS, AND METHODS OF OPERATING HYDROCARBON WELLS

(71) Applicant: ExxonMobil Upstream Research Company, Spring, TX (US)

(72) Inventors: Rami Jabari, The Woodlands, TX (US); P. Matthew Spiecker, Manvel, TX (US); Michael C. Romer, The Woodlands, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 70 days.

(21) Appl. No.: 16/865,146

(22) Filed: May 1, 2020

(65) Prior Publication Data

US 2020/0378242 A1 Dec. 3, 2020

Related U.S. Application Data

(60) Provisional application No. 62/912,464, filed on Oct. 8, 2019, provisional application No. 62/854,724, filed on May 30, 2019.

(51) Int. Cl.
*E21B 47/09* (2012.01)
*E21B 33/12* (2006.01)
(Continued)

(52) U.S. Cl.
CPC ..... *E21B 47/09* (2013.01); *E21B 33/12* (2013.01); *E21B 47/06* (2013.01); *E21B 47/07* (2020.05);
(Continued)

(58) Field of Classification Search
CPC ..... E21B 47/09; E21B 33/12; E21B 47/095; E21B 47/11; E21B 47/07; E21B 47/10;
(Continued)

(56) References Cited

U.S. PATENT DOCUMENTS 5,831,156 A * 11/1998 Mullins ..... E21B 41/0085 73/152.18
5,995,020 A * 11/1999 Owens ..... E21B 47/12 166/250.01

(Continued)

*Primary Examiner* — Steven A Macdonald
(74) *Attorney, Agent, or Firm* — Leandro Arechederra, III

(57) ABSTRACT

Downhole plugs including a sensor, hydrocarbon wells including the downhole plugs, and methods of operating the hydrocarbon wells. The downhole plugs include a sealing structure, an actuation mechanism, and the sensor. The actuation mechanism is configured to selectively transition the sealing structure between a disengaged state, in which the downhole plug is free to move within a tubular conduit of a downhole tubular of the hydrocarbon well, and an engaged state, in which the sealing structure operatively engages with the downhole tubular, forms a fluid seal with the downhole tubular, and resists motion of the downhole plug within the tubular conduit. The sensor is configured to detect a sensed parameter within the tubular conduit and to generate a sensor signal indicative of the sensed parameter.

24 Claims, 3 Drawing Sheets

(51) Int. Cl.
*E21B 47/095* (2012.01)
*E21B 47/11* (2012.01)
*E21B 47/07* (2012.01)
*E21B 47/10* (2012.01)
*E21B 47/12* (2012.01)
*E21B 47/06* (2012.01)

(52) U.S. Cl.
CPC ..... *E21B 47/095* (2020.05); *E21B 47/10* (2013.01); *E21B 47/11* (2020.05); *E21B 47/12* (2013.01)

(58) Field of Classification Search
CPC ..... E21B 47/12; E21B 47/06; E21B 49/08; E21B 47/006; E21B 47/01; E21B 47/024; E21B 43/261
See application file for complete search history.

(56) References Cited

U.S. PATENT DOCUMENTS 6,135,204 A * 10/2000 McCabe ..... E21B 33/127 166/250.17
2002/0011333 A1* 1/2002 Ward ..... E21B 49/08 166/250.07
2002/0116129 A1* 8/2002 Alft ..... E21B 7/04 702/9
2003/0066652 A1* 4/2003 Stegemeier ..... E21B 47/12 166/373
2004/0173363 A1* 9/2004 Navarro-Sorroche ..... E21B 47/06 166/387
2005/0104176 A1* 5/2005 Rodney ..... E21B 47/002 257/678
2006/0102342 A1* 5/2006 East ..... E21B 47/01 166/250.1
2008/0236814 A1* 10/2008 Roddy ..... E21B 47/12 166/250.01
2008/0272931 A1* 11/2008 Auzerais ..... E21B 47/005 340/854.7
2009/0038802 A1* 2/2009 Lucas ..... E21B 33/12 166/299
2009/0294174 A1* 12/2009 Harmer ..... E21B 47/06 175/45
2010/0212891 A1* 8/2010 Stewart ..... E21B 23/00 166/250.12
2010/0294480 A1* 11/2010 Lavrut ..... E21B 41/0035 166/66
2012/0055669 A1* 3/2012 Levin ..... E21B 33/1208 166/250.17
2012/0175135 A1* 7/2012 Dyer ..... E21B 47/01 166/387
2012/0279292 A1* 11/2012 Simonian ..... G01F 1/44 73/152.51
2014/0034301 A1* 2/2014 Leblanc ..... E21B 33/16 166/250.14
2014/0273831 A1* 9/2014 Walton ..... E21B 43/119 455/41.1
2014/0338886 A1* 11/2014 Macrae ..... E21B 47/00 166/65.1
2015/0041124 A1* 2/2015 Rodriguez ..... E21B 23/06 166/255.1
2015/0041137 A1* 2/2015 Rodriguez ..... E21B 43/14 166/301
2015/0134253 A1* 5/2015 Ring ..... E21B 47/12 702/6
2016/0084075 A1* 3/2016 Ingraham ..... E21B 23/10 166/255.1
2016/0090834 A1* 3/2016 Morrow ..... E21B 47/007 340/853.2
2016/0130893 A1* 5/2016 Pound ..... E21B 43/12 700/282
2016/0305232 A1* 10/2016 Bird ..... E21B 47/024
2017/0159423 A1* 6/2017 Merino ..... E21B 47/053
2017/0314372 A1* 11/2017 Tolman ..... E21B 43/116
2017/0335678 A1* 11/2017 Ciezobka ..... E21B 47/07
2018/0202269 A1* 7/2018 Wensrich ..... E21B 43/26
2018/0298717 A1* 10/2018 Costa De Oliveira ..... E21B 33/12955
2018/0306001 A1* 10/2018 Themig ..... E21B 43/26
2019/0007159 A1* 1/2019 Dufour ..... H04L 1/0003
2019/0100973 A1* 4/2019 Lauritzen ..... E21B 43/11
2019/0323342 A1* 10/2019 Pedersen ..... E21B 33/12

* cited by examiner

DOWNHOLE PLUGS INCLUDING A SENSOR, HYDROCARBON WELLS INCLUDING THE DOWNHOLE PLUGS, AND METHODS OF OPERATING HYDROCARBON WELLS

CROSS REFERENCE TO RELATED APPLICATION

This application claims the benefit of U.S. Provisional Application 62/854,724 filed May 30, 2019 entitled "Smart Plugs" the entirety of which is incorporated by reference herein. This application also claims the benefit of U.S. Provisional Application 62/912,464 filed Oct. 8, 2019 entitled "Downhole Plugs Including a Sensor, Hydrocarbon Wells Including the Downhole Plugs, and Methods of Operating Hydrocarbon Wells."

FIELD OF THE DISCLOSURE

The present disclosure is directed generally to downhole plugs that include a sensor, to hydrocarbon wells that include the downhole plugs, and/or to methods of operating the hydrocarbon wells.

BACKGROUND OF THE DISCLOSURE

In conventional hydrocarbon wells, conventional plugs may be utilized to form a fluid seal within a wellbore, such as to fluidly isolate a region of the wellbore that is uphole from the conventional plug from a region of the wellbore that is downhole from the conventional plug. Conventional plugs are utilized in a variety of wellbore operations, including completion operations and generally are removed from the wellbore after completion operations have been performed. In relatively shorter wellbores, coiled tubing and/or workover strings may be utilized to mill the conventional plugs from the wellbore. In relatively longer wells, some plugs may be out of reach of the coiled tubing and/or workover strings. In these wells, dissolvable plugs instead may be utilized. The dissolvable plugs are configured to dissolve upon contact with a wellbore fluid. While effective when utilized, plug removal via coiled tubing and/or workover strings is time-consuming and expensive. In addition, there currently is no mechanism to readily identify if and/or when a dissolvable plug has fully dissolved. Furthermore, there currently is no mechanism to readily identify if a sand bridge and/or other downhole obstruction is forming and/or has formed near a conventional plug.

SUMMARY OF THE DISCLOSURE

Downhole plugs including a sensor, hydrocarbon wells including the downhole plugs, and/ methods of operating the hydrocarbon wells. The downhole plugs include a sealing structure, an actuation mechanism, and the sensor. The actuation mechanism may be configured to selectively transition the sealing structure between a disengaged state and an engaged state. In the disengaged state, the downhole plug is free to move within a tubular conduit of a downhole tubular of the hydrocarbon well. In the engaged state, the sealing structure operatively engages with the downhole tubular, forms a fluid seal with the downhole tubular, and resists motion of the downhole plug within the tubular conduit. The sensor may be configured to detect a sensed parameter within the tubular conduit and to generate a sensor signal indicative of the sensed parameter.

The hydrocarbon wells include a wellbore that extends within a subsurface region and a downhole tubular that extends within the wellbore and defines a tubular conduit. The hydrocarbon wells also include at least one downhole plug, which may be positioned within the tubular conduit.

The methods include sensing a sensed parameter with a sensor of a downhole plug and generating a sensor signal with the sensor. The downhole plug may be positioned within a tubular conduit of a downhole tubular of a hydrocarbon well, and the downhole tubular may extend within a subsurface region. The sensor signal may be indicative of the sensed parameter.

DETAILED DESCRIPTION AND BEST MODE OF THE DISCLOSURE

Figure 1:
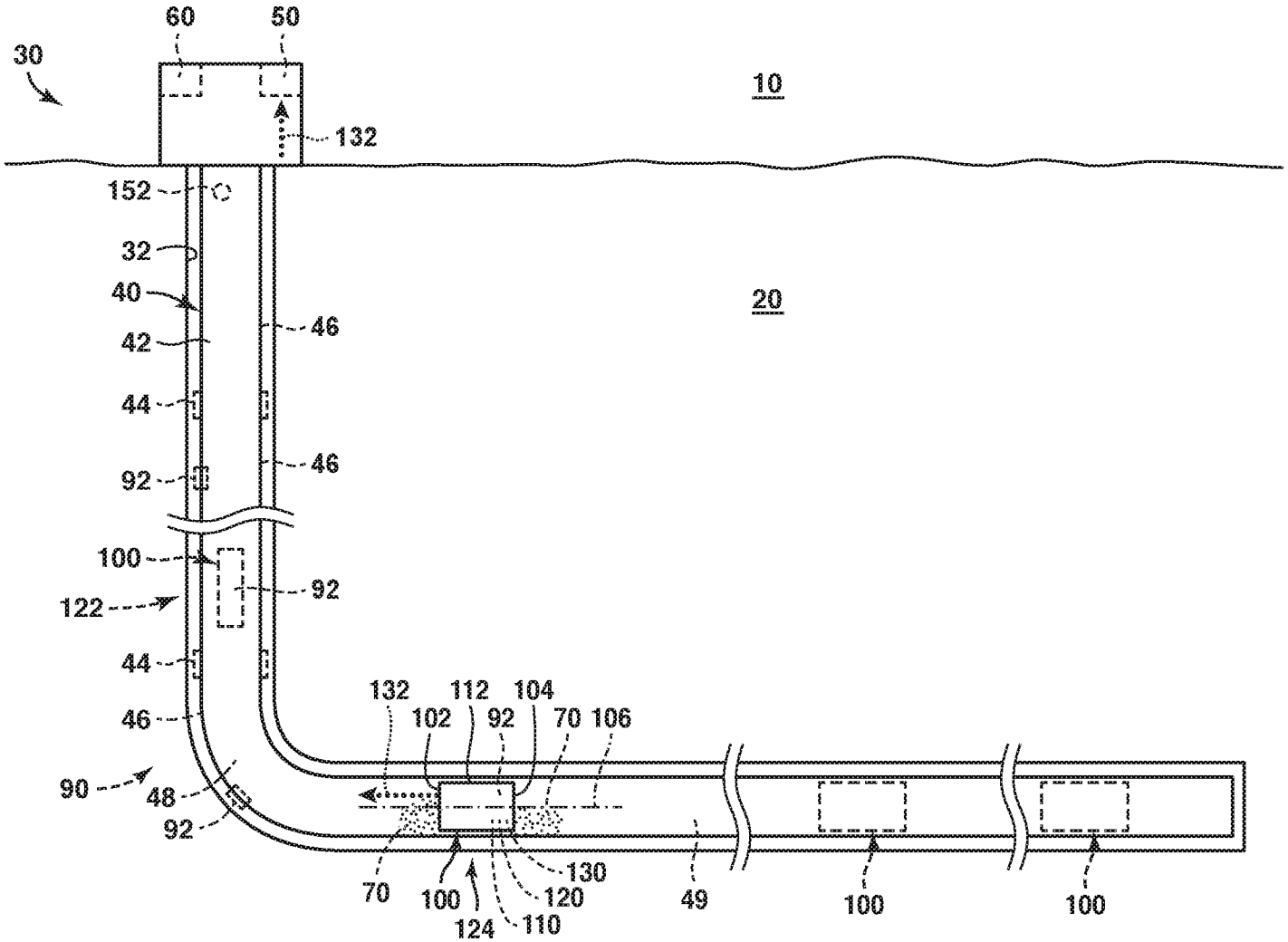
FIG. 1 is a schematic illustration of examples of hydrocarbon wells that may include a downhole plug, according to the present disclosure.
Figure 2:
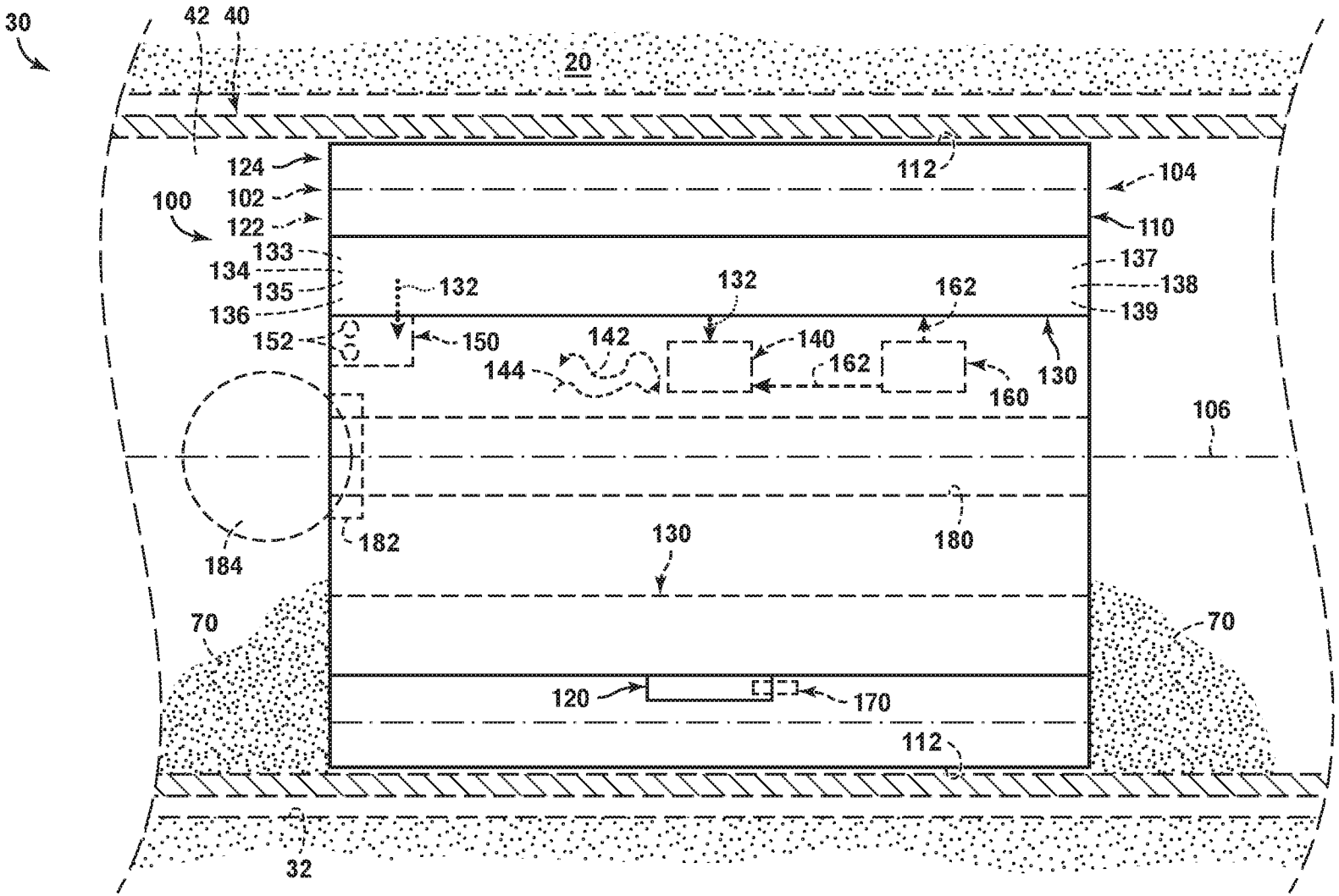
FIG. 2 is a schematic illustration of examples of downhole plugs, according to the present disclosure.
Figure 3:
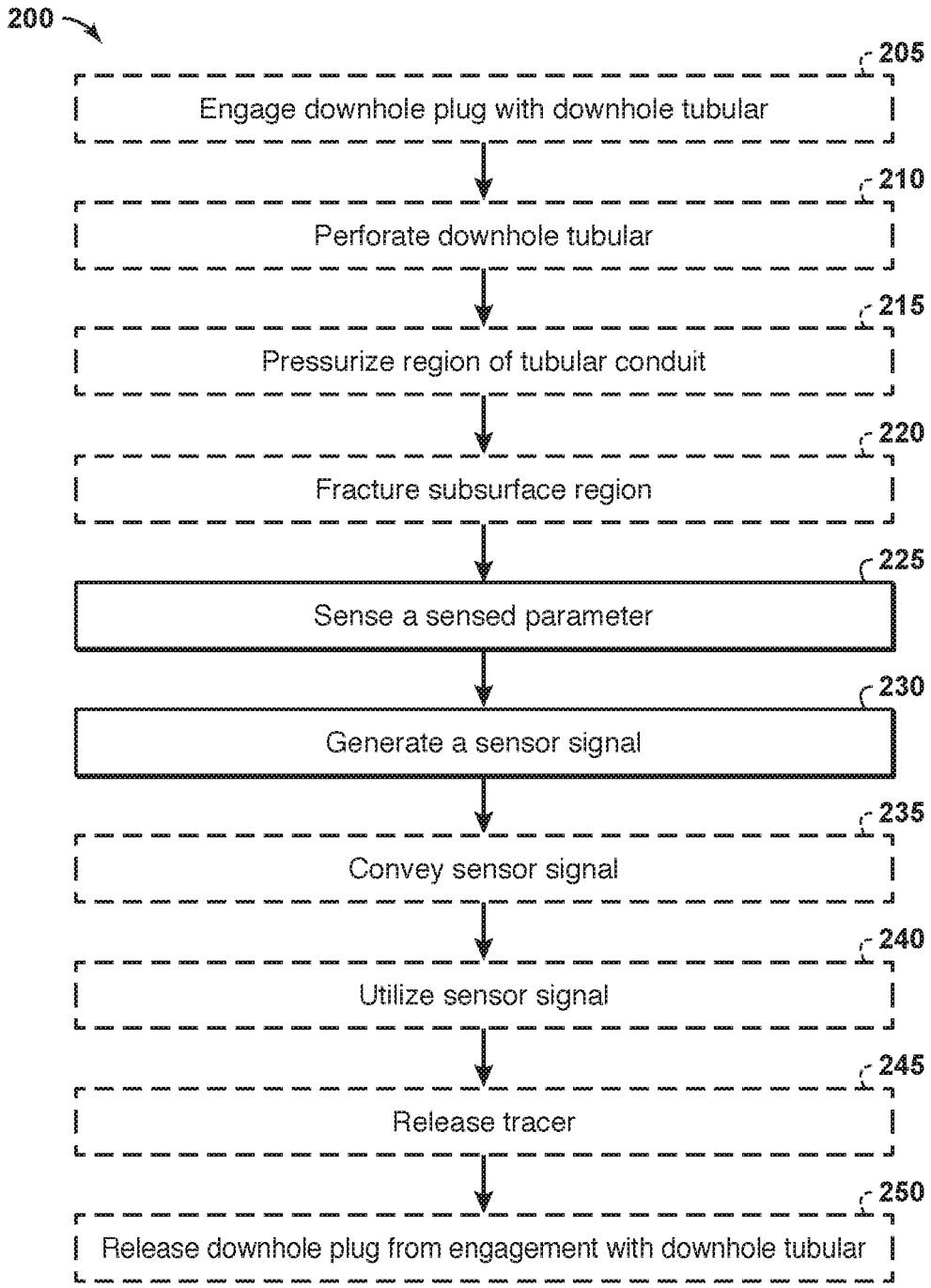
FIG. 3 is a flowchart depicting examples of methods of operating a hydrocarbon well, according to the present disclosure.

FIGS. 1-3 provide examples of downhole plugs 100, of hydrocarbon wells 30, and/or of methods 200 of operating hydrocarbon wells, according to the present disclosure. Elements that serve a similar, or at least substantially similar, purpose are labeled with like numbers in each of FIGS. 1-3, and these elements may not be discussed in detail herein with reference to each of FIGS. 1-3. Similarly, all elements may not be labeled in each of FIGS. 1-3, but reference numerals associated therewith may be utilized herein for consistency. Elements, components, and/or features that are discussed herein with reference to one or more of FIGS. 1-3 may be included in and/or utilized with any of FIGS. 1-3 without departing from the scope of the present disclosure.

In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic illustration of examples of hydrocarbon wells 30 that may include at least one downhole plug 100, according to the present disclosure. Hydrocarbon wells 30 include a wellbore 32 that extends within a subsurface region 20. Wellbore 32 also may be referred to herein as extending between a surface region 10 and subsurface region 20. Hydrocarbon wells 30 also include a downhole tubular 40 that extends within wellbore 32. Downhole tubular 40 defines and/or at least partially bounds a tubular conduit 42. In some examples, downhole tubular 40 includes a plurality of tubing segments 46 that may be joined together by a plurality of corresponding collars 44.

Hydrocarbon wells 30 also include at least one downhole plug 100, which may be positioned within tubular conduit 42. Downhole plug 100 also may be referred to herein as a plug 100 and includes a sealing structure 110, an actuation mechanism 120, and a sensor 130. As discussed in more detail herein, actuation mechanism 120 may be configured to selectively transition sealing structure 110 between a disengaged state 122, as illustrated in dashed lines in FIG. 1, and an engaged state 124, as illustrated in solid lines in FIG.

1. When sealing structure 110 is in disengaged state 122, downhole plug 100 may be free to move within tubular conduit 42. In contrast, when sealing structure 110 is in engaged state 124, sealing structure 110 may operatively engage with downhole tubular 40, may form a fluid seal 112 with the downhole tubular, and/or may resist motion of the downhole plug within the tubular conduit. As also discussed in more detail herein, sensor 130 may be configured to detect a sensed parameter within the tubular conduit and/or to generate a sensor signal 132 that may be based upon and/or indicative of the sensed parameter.

In some examples, and as illustrated in dashed lines in FIG. 1, hydrocarbon well 30 may include an uphole communication structure 50. Uphole communication structure 50, when present, may be configured to receive sensor signal 132 from downhole plug 100. The sensed parameter then may be displayed, provided to an operator of the hydrocarbon well, stored, and/or responded to, as discussed in more detail herein.

In some examples, and as also illustrated in dashed lines in FIG. 1, hydrocarbon well 30 may include a downhole communication network 90. Downhole communication network 90, when present, may include any suitable structure that may be configured to convey sensor signal 132 and/or the sensed parameter to surface region 10 and/or to uphole communication structure 50.

As an example, hydrocarbon well 30 may include a plurality of downhole plugs 100. In this example, each downhole plug may be configured to communicate with at least one other downhole plug to at least partially define the downhole communication network. Stated another way, downhole plugs 100 may function as communication nodes 92 of downhole communication network 90. As another example, downhole communication network 90 may include one or more communication nodes 92 that may be separate, distinct, and/or spaced-apart from downhole plugs 100. It is within the scope of the present disclosure that downhole communication network 90 may include and/or be a wired and/or a wireless downhole communication network.

In some examples, and as discussed in more detail herein, downhole plugs 100 may be configured to release a tracer 152. In these examples, hydrocarbon wells 30 may include a tracer detection structure 60, which may be configured to detect tracer 152.

During operation of hydrocarbon wells 30, and as discussed in more detail herein with reference to methods 200 of FIG. 3, one or more downhole plugs 100 may be flowed into and/or positioned within tubular conduit 42 while a corresponding sealing structure of the downhole plugs is in disengaged state 122. Subsequently, the sealing structure may be transitioned to engaged state 124, thereby operatively engaging the downhole plug with the downhole tubular, forming fluid seal 112 between the downhole plug and the downhole tubular, resisting motion of the downhole plug within the tubular conduit, and/or restricting fluid flow between a region 48 of tubular conduit 42 that is uphole from the downhole plug and a region 49 of the tubular conduit that is downhole from the downhole plug.

While downhole plug 100 is within tubular conduit 42, sensor 130 may be utilized to detect the sensed parameter and/or to generate sensor signal 132. In addition, plug 100 may be configured to convey the sensed parameter, such as via sensor signal 132, to uphole communication structure 50 and/or to surface region 10, such as via downhole communication network 90. As discussed in more detail herein, knowledge of the sensed parameter may provide additional and/or relevant information regarding downhole conditions within the hydrocarbon well, may be utilized to make decisions regarding operation of the hydrocarbon well, may be utilized to verify an integrity of various components of the hydrocarbon well, and/or may be utilized to prevent undesirable conditions within the hydrocarbon well. As such, hydrocarbon wells 30 that include downhole plugs 100, according to the present disclosure, may provide significant benefits over conventional plugs that do not include sensors.

FIG. 2 is a schematic illustration of examples of downhole plugs 100 according to the present disclosure. FIG. 2 may include and/or be a more detailed, but still schematic, illustration of downhole plugs 100 and/or of a region of hydrocarbon wells 30 of FIG. 1. As such, any of the structures, functions, and/or features that are discussed herein with reference to downhole plugs 100 of FIG. 2 may be included in and/or utilized with hydrocarbon wells 30 of FIG. 1 without departing from the scope of the present disclosure. Similarly, any of the structures, functions, and/or features of hydrocarbon wells 30 of FIG. 1 may be included in and/or utilized with downhole plugs 100 of FIG. 2 without departing from the scope of the present disclosure.

As discussed, downhole plug 100 is configured to be positioned within tubular conduit 42 of downhole tubular 40. Downhole tubular 40 may extend within wellbore 32 of hydrocarbon well 30, and wellbore 32 may extend and/or may be defined within subsurface region 20.

As also discussed, downhole plug 100 includes sealing structure 110, actuation mechanism 120, and sensor 130. Actuation mechanism 120 may be configured to transition, or to selectively transition, sealing structure 110 between disengaged state 122, which is illustrated in dash-dot lines in FIG. 2, and engaged state 124, which is illustrated in solid lines in FIG. 2. Sensor 130 is configured to detect the sensed parameter within tubular conduit 42 and/or to generate sensor signal 132 that is indicative of the sensed parameter.

Sensor 130 may include any suitable structure that may be adapted, configured, designed, and/or constructed to detect the sensed parameter and/or to produce and/or generate the sensor signal. This may include any suitable electrical, or electrically actuated, sensor, any suitable mechanical, or mechanically actuated, sensor, any suitable hydraulic, or hydraulically actuated, sensor, any suitable pneumatic, or pneumatically actuated, sensor, and/or any suitable chemical, or chemically actuated, sensor.

In one example, sensor 130 may include and/or be a downhole obstruction detection structure 133. In this example, the sensed parameter may include, may be, and/or may be indicative of the presence and/or formation of a downhole obstruction 70 within tubular conduit 42 and/or proximate downhole plug 100. As used herein, the phrase "downhole obstruction" may refer to any partial and/or complete obstruction of tubular conduit 42 that may be at least partially formed and/or defined by a buildup, an agglomeration, and/or a collection of debris, scale, proppant, corrosion products, hydrocarbon solids, and/or portions of one or more downhole components, such as a portion of a partially dissolved downhole plug within tubular conduit 42 and/or proximate downhole plug 100. In some examples, the downhole obstruction may be at least partially, or even completely, formed and/or defined by sand. In these examples, the downhole obstruction also may be referred to herein as a sand bridge.

The downhole obstruction detection structure may be configured to detect formation of downhole obstruction 70 uphole from, or proximate an uphole end 102 of, downhole plug 100. Additionally or alternatively, the downhole obstruction detection structure may be configured to detect formation of the downhole obstruction downhole from, or proximate downhole end 104 of, downhole plug 100.

An example of downhole obstruction detection structure 133 includes an infrared downhole obstruction detection sensor, which may be configured to detect an infrared signature indicative of formation of the downhole obstruction within the tubular conduit and/or proximate the downhole plug. Another example of downhole obstruction detection structure 133 includes a piezoelectric downhole obstruction detection sensor, which may be configured to detect mechanical contact between the downhole obstruction and the downhole plug. Yet another example of downhole obstruction detection structure 133 includes a microelectromechanical system downhole obstruction detection sensor, which may be configured to detect formation of the downhole obstruction within the tubular conduit and proximate the downhole plug, such as via detection of mechanical contact between the downhole obstruction and the downhole plug. Still another example of downhole obstruction detection structure 133 includes an ultrasonic downhole obstruction detection sensor, which may be configured to detect an ultrasonic signature indicative of formation of the downhole obstruction within the tubular conduit and proximate the downhole plug. Another example of downhole obstruction detection structure 133 includes a strain gauge downhole obstruction detection sensor, which may be configured to detect mechanical strain applied to the downhole plug by the downhole obstruction.

In another example, sensor 130 may include and/or be a temperature sensor 134. In this example, the sensed parameter may include and/or be a temperature proximate downhole plug 100 and/or within tubular conduit 42. Such a temperature sensor may permit and/or facilitate collection of data indicative of the temperature within the tubular conduit as a function of time and/or position within the tubular conduit, such as when the downhole plug is flowed into position within the tubular conduit while in disengaged state 122. Additionally or alternatively, such a temperature sensor may permit and/or facilitate collection of data indicative of the temperature within the tubular conduit as a function of time, such as when, or after, the downhole plug is positioned within the tubular conduit and transitioned to engaged state 124.

In another example, sensor 130 may include and/or be a pressure sensor 135. In this example, the sensed parameter may include and/or be a pressure proximate downhole plug 100 and/or within tubular conduit 42. In a variant of this example, the sensor, or the pressure sensor, may include and/or be a differential pressure sensor. In this example, the sensed parameter may include and/or be a pressure differential between uphole end 102 and downhole end 104 of downhole plug 100.

Such a pressure sensor may permit and/or facilitate collection of data indicative of the pressure within the tubular conduit as a function of time and/or position within the tubular conduit, such as when the downhole plug is flowed into position within the tubular conduit while in disengaged state 122. Additionally or alternatively, such a pressure sensor may permit and/or facilitate collection of data indicative of the pressure within the tubular conduit and/or of the differential pressure across the downhole plug as a function of time, such as when, or after, the downhole plug is positioned within the tubular conduit and transitioned to engaged state 124.

In another example, sensor 130 may include and/or be an accelerometer 136. In this example, the sensed parameter may include and/or be acceleration and/or motion of downhole plug within tubular conduit 42. Such an accelerometer may permit and/or facilitate collection of data indicative of the motion of the downhole plug within the tubular conduit as a function of time and/or position within the tubular conduit, such as when the downhole plug is flowed into position within the tubular conduit while in disengaged state 122. Additionally or alternatively, such an accelerometer may permit and/or facilitate collection of data indicative of the motion of the downhole plug within the tubular conduit as a function of time, such as when, or after, the downhole plug is positioned within the tubular conduit and transitioned to engaged state 124. Such motion, if detected, may be indicative of failure of the downhole plug.

In another example, sensor 130 may include and/or be a collar locator 137. In this example, the sensed parameter may include and/or be motion of the downhole plug past a collar, such as collar 44 of FIG. 1, of the downhole tubular. Such a collar locator may permit and/or facilitate collection of data indicative of the motion of the downhole plug past the collar as a function of time and/or position within the tubular conduit, such as when the downhole plug is flowed into position within the tubular conduit while in disengaged state 122. Additionally or alternatively, such a collar locator may permit and/or facilitate collection of data indicative of the motion of the downhole plug past the collar as a function of time, such as when, or after, the downhole plug is positioned within the tubular conduit and transitioned to engaged state 124. Such motion, if detected, may be indicative of failure of the downhole plug.

In another example, sensor 130 may include and/or be a velocity sensor 138. In this example, the sensed parameter may include and/or be a velocity of fluid flow past the downhole plug within the tubular conduit. Such a velocity sensor may permit and/or facilitate collection of data indicative of the velocity of fluid flow past the downhole plug as a function of time, such as when, or after, the downhole plug is positioned within the tubular conduit and transitioned to engaged state 124. Such velocity of fluid flow, if detected and/or nonzero during completion operations, may be indicative of failure of the downhole plug. Additionally or alternatively, such velocity of fluid flow, if detected and/or nonzero during flow back and/or production operations, may provide additional information regarding production from various region(s) of the hydrocarbon well and/or of the subsurface region.

In another example, sensor 130 may include and/or be a flow meter 139. In this example, the sensed parameter may include and/or be a flow rate of fluid past the downhole plug within the tubular conduit. Such a flow meter may permit and/or facilitate collection of data indicative of the flow rate of fluid past the downhole plug as a function of time, such as when, or after, the downhole plug is positioned within the tubular conduit and transitioned to engaged state 124. Such flow rate of fluid, if detected and/or nonzero during completion operations, may be indicative of failure of the downhole plug. Additionally or alternatively, such flow rate of fluid, if detected and/or nonzero during flow back and/or production operations, may provide additional information regarding production from various region(s) of the hydrocarbon well and/or of the subsurface region.

Additional examples of sensor 130 include a densitometer and/or a capacitance-conductance sensor. When sensor 130 includes the densitometer, the sensed parameter may include and/or be a density of fluid and/or of material that is proximal to and/or that contacts the sensor. Such information may permit and/or facilitate determination of a fluid phase (e.g., liquid or gas) of the fluid that is proximal to the sensor and/or may be indicative of the presence of solids, such as sand, proximal to the sensor. When sensor 130 includes the capacitance-conductance sensor, the sensed parameter may include and/or be a capacitance and/or an electrical conductance of fluid that is proximal to and/or that contacts the sensor. Such information may permit and/or facilitate determination and/or estimation of an identity of the fluid that is proximal to the sensor (e.g., hydrocarbon fluid or water).

As illustrated in dashed lines in FIG. 2, downhole plug 100 may include a communication device 140. Communication device 140, when present, may be configured to facilitate communication between the downhole plug and another structure of the hydrocarbon well, such as downhole wireless network 90 and/or uphole communication structure 50 of FIG. 1. As an example, communication device 140 may be configured to transmit the sensor signal, as indicated at 142 in FIG. 2. Such a sensor signal that is transmitted by communication device 140 also may be referred to herein as communication data 142 that is indicative of sensor signal 132 and/or of the sensed parameter. Examples of communication device 140 include an acoustic transmitter, an acoustic receiver, a radio frequency transmitter, and/or a radio frequency receiver.

In some examples, communication device 140 additionally or alternatively may be configured to receive a received signal 144. In this example, received signal 144 may be received from another downhole plug of the hydrocarbon well and/or to transmit the received signal to yet another plug of the hydrocarbon well, such as when a plurality of downhole plugs 100 form and/or define at least a portion of downhole communication network 90, as discussed herein with reference to FIG. 1.

As also illustrated in dashed lines in FIG. 2, downhole plug 100 may include a tracer release structure 150. Tracer release structure 150 may be configured to release, or to selectively release, tracer 152 from downhole plug 100 and/or into tubular conduit 42. The tracer then may be conveyed from the hydrocarbon well toward and/or to the surface region in a produced fluid stream that may be produced from the hydrocarbon well.

In some examples, tracer release structure 150 may be configured to release one or more tracers 152 at least partially responsive to the sensed parameter being within a predetermined sensed parameter range, at least partially responsive to formation of a downhole obstruction within the tubular conduit and/or proximate the downhole plug, at least partially responsive to expiration of a predetermined tracer release time interval, and/or at least partially responsive to destruction of the downhole plug.

As discussed in more detail herein with reference to FIG. 1, hydrocarbon wells 30 that include and/or utilize downhole plugs 100 may include tracer detection structure 60. As such, release of tracers 152 may be detected by the tracer detection structure, thereby providing an additional and/or an alternative mechanism via which downhole plugs 100 may communicate with the surface region.

Tracers 152 may include any suitable structure and/or structures. In some examples, the tracers may include a unique identifier that uniquely identifies a given plug, or a given region of the given plug, from which the tracer was released. As another example, the tracers may include a memory and may be utilized to convey the sensed parameter, or a time trace of the sensed parameter, to the surface region.

As also illustrated in dashed lines in FIG. 2, downhole plugs 100 may include an energy source 160. Energy source 160 may be configured to power, or to provide energy 162, to at least one other component of the downhole plug, such as actuation mechanism 120, sensor 130, communication device 140, and/or tracer release structure 150. In some examples, energy source 160 may include and/or be an energy storage device, such as a battery and/or a capacitor. In some examples, energy source 160 may include and/or be an energy harvesting structure configured to harvest energy from and/or within the tubular conduit. Examples of energy 162 include electrical energy, chemical energy, pneumatic energy, hydraulic energy, and/or mechanical energy.

As also illustrated in dashed lines in FIG. 2, downhole plugs 100 may include a release mechanism 170. Release mechanism 170 may be configured to selectively release the downhole plug from operative engagement with the tubular conduit. Examples of release mechanism 170 include a self-destruct mechanism configured to at least partially destroy at least a portion of the downhole plug, an implosion mechanism configured to at least partially implode the downhole plug, and/or a dissolution mechanism configured to at least partially dissolve and/or corrode the downhole plug. When release mechanism 170 includes the dissolution mechanism, the dissolution mechanism may be configured to selectively release a dissolution chemical, which may produce and/or initiate dissolution of the downhole plug. As another example, release mechanism 170 may include actuation mechanism 120 and/or may be configured to direct actuation mechanism 120 to selectively transition the sealing structure from engaged state 124 to the disengaged state 122.

It is within the scope of the present disclosure that release mechanism 170, when present, may be configured to selectively release the downhole plug from operative engagement with the tubular conduit based upon and/or responsive to any suitable criteria. As examples, the release mechanism may be configured to selectively release the downhole plug at least partially responsive to the sensed parameter being within a predetermined sensed parameter range, at least partially responsive to formation of a downhole obstruction within the tubular conduit and/or proximate the downhole plug, at least partially responsive to expiration of a predetermined downhole plug release time interval, and/or at least partially responsive to receipt of a release signal.

As illustrated in dashed lines in FIG. 2, downhole plug 100 may include a through hole 180. Through hole 180 may extend between uphole end 102 and downhole end 104 of the downhole plug. When downhole plug 100 includes through hole 180, the downhole plug also may include a frac seat 182, which also may be referred to herein as a ball sealer seat 182 and/or as a ball seat 182. Frac seat 182 may be defined on uphole end 102 and/or may be configured to receive a frac ball 184, which also may be referred to herein as a ball sealer 184. Frac seat 182, in combination with frac ball 184, may selectively restrict fluid flow, via through hole 180, from uphole end 102 toward downhole end 104 of downhole plug 100 and/or may selectively permit fluid flow, via through hole 180, from downhole end 104 toward uphole end 102 of the downhole plug.

Actuation mechanism 120 may include any suitable structure that may be adapted, configured, designed, and/or constructed to selectively transition sealing structure 110 from disengaged state 122 to engaged state 124 and/or between the disengaged state and the engaged state. In some examples, sealing structure 110 may include and/or be a resilient sealing structure, and actuation mechanism 120 may be configured to compress, to expand, and/or to radially expand the resilient sealing structure to transition the sealing structure from the disengaged state to the engaged state. This may include mechanical compression of the resilient sealing structure along a longitudinal axis 106 of the downhole plug. Examples of the sealing structure include an elastomeric body and/or a metallic body that may be configured to deform and/or to expand to form and/or define the fluid seal.

In some examples, actuation mechanism 120 may be configured to receive an external force, or an external motive force, such as from a setting tool, to transition the sealing structure from the disengaged state to the engaged state. In such examples, actuation mechanism may include any suitable lever, cam, and/or bearing surface that may receive the external force and/or that may transition the sealing structure from the disengaged state to the engaged state.

FIG. 3 is a flowchart depicting examples of methods 200 of operating a hydrocarbon well, such as hydrocarbon well 30 of FIG. 1, according to the present disclosure. Methods 200 may include engaging a downhole plug with a downhole tubular at 205, perforating the downhole tubular at 210, pressurizing a region of a tubular conduit at 215, and/or fracturing a subsurface region at 220. Methods 200 include sensing a sensed parameter at 225 and generating a sensor signal at 230, and methods 200 further may include conveying the sensor signal at 235 and/or utilizing the sensor signal at 240. Methods 200 also may include releasing a tracer at 245 and/or releasing the downhole plug from engagement with the downhole tubular at 250.

As discussed in more detail herein, the downhole plug may be positioned within the tubular conduit, which may be formed, defined, and/or at least partially bounded by the downhole tubular. The downhole tubular may extend within a wellbore of the hydrocarbon well. Examples of the downhole plug, the tubular conduit, the downhole tubular, the wellbore, and the hydrocarbon well are disclosed herein with reference to downhole plug 100, tubular conduit 42, downhole tubular 40, wellbore 32, and/or hydrocarbon well 30, respectively, of FIGS. 1-2.

Engaging the downhole plug with the downhole tubular at 205 may include operatively and/or mechanically engaging, or interlocking, the downhole plug with the downhole tubular. This may include engaging the downhole plug with the downhole tubular to form a fluid seal between the downhole plug and the downhole tubular and/or to resist motion of the downhole plug within the tubular conduit. In some examples, the engaging at 205 may include transitioning the downhole plug from a disengaged state to an engaged state. Examples of the fluid seal, the disengaged state, and the engaged state are disclosed herein with reference to fluid seal 112, disengaged state 122, and engaged state 124, respectively, of FIGS. 1-2.

Perforating the downhole tubular at 210 may include creating one or more perforations within the downhole tubular. This may include creating the perforations within a region of the downhole tubular that forms, defines, and/or at least partially bounds the region of the tubular conduit that is pressurized during the pressurizing at 215. The perforating at 210 additionally or alternatively may be referred to herein as establishing fluid communication between the tubular conduit and the subsurface region via the one or more perforations. The perforating at 210 may be performed subsequent to the engaging at 205, prior to the pressurizing at 215, and/or subsequent to the pressurizing at 215. The perforating at 210 may be performed in any suitable manner and/or utilizing any suitable structure. As examples, a perforation device, such as a perforation gun and/or a shaped charge perforation device may be utilized to perform the perforating at 210.

Pressurizing the region of the tubular conduit at 215 may include pressurizing a region of the tubular conduit that is uphole from the downhole plug. This may include pressurizing with a pressurizing fluid and/or with a pressurizing fluid stream, such as by providing the pressurizing fluid and/or the pressurizing fluid stream to the region of the tubular conduit that is uphole from the downhole plug. The pressurizing at 215, when performed, may be subsequent to the engaging at 205. Stated another way, the engaging at 205, or the fluid seal that is formed during the engaging at 205 may permit and/or facilitate the pressurizing at 215, such as by limiting and/or restricting fluid flow past the downhole plug and within the tubular conduit.

Fracturing the subsurface region at 220 may include fracturing the subsurface region with the pressurizing fluid and/or with the pressurizing fluid stream. Stated another way, the fracturing at 220 may include flowing the pressurizing fluid into the subsurface region to produce and/or generate at least one fracture within the subsurface region. This may include flowing with, via, and/or utilizing the one or more perforations created during the perforating at 210. The fracturing at 220 may be performed subsequent to the engaging at 205, subsequent to the perforating at 210, subsequent to the pressurizing at 215, and/or at least partially responsive to the pressurizing at 215.

Sensing the sensed parameter at 225 may include sensing the sensed parameter with, via, and/or utilizing a sensor of the downhole plug. Examples of the sensor are disclosed herein with reference to sensor 130 of FIGS. 1-2. The sensing at 225 may be performed with any suitable timing and/or sequence during methods 200. Additionally or alternatively, the sensing at 225 may be performed a single time, may be performed intermittently, may be performed periodically, may be performed continuously, and/or may be performed at least substantially continuously during methods 200 and/or during any suitable step of methods 200. As examples, the sensing at 225 may be performed prior to, during, concurrently with, at least partially concurrently with, and/or after one or more of the engaging at 205, the perforating at 210, the pressurizing at 215, the fracturing at 220, the conveying at 235, the utilizing at 240, the releasing at 245, and/or the releasing at 250.

The sensing at 225 generally will be performed while the downhole plug is positioned within the tubular conduit. With this in mind, it follows that the sensed parameter may be indicative of one or more conditions within and/or properties of the wellbore, the hydrocarbon well, and/or the subsurface region. Examples of the sensed parameter are discussed in more detail herein with reference to FIGS. 1-2 and include a temperature proximate the downhole plug and/or within the tubular conduit, a pressure proximate the downhole plug and/or within the tubular conduit, a differential pressure between an uphole end of the downhole plug and a downhole end of the downhole plug, an acceleration of the downhole plug within the tubular conduit, motion of the downhole plug past a casing collar of the downhole tubular, formation of a downhole obstruction within the tubular conduit and/or proximate the downhole plug, a velocity of fluid flow past the downhole plug within the tubular conduit, and/or a flow rate of fluid past the downhole plug within the tubular conduit.

Generating the sensor signal at 230 may include generating the sensor signal with, via, and/or utilizing the sensor. The sensor signal may be based upon and/or indicative of the sensed parameter. Stated another way, upon receipt of the sensor signal, another component of the hydrocarbon well may utilize the sensor signal to determine, to calculate, to estimate, and/or to recreate the sensed parameter. Stated yet another way, and as discussed in more detail herein, the sensor signal may be utilized to convey, or to convey a value of, the sensed parameter to the other component of the hydrocarbon well. The generating at 230 may be at least partially responsive to and/or a result of the sensing at 225. As such, the generating at 230 may be performed subsequent to, or subsequent to each instance of, the sensing at 225.

Conveying the sensor signal at 235 may include conveying the sensor signal to the other component of the hydrocarbon well, to an operator of the hydrocarbon well, and/or to a surface region. Stated another way, the conveying at 235 may be utilized to inform the operator of the hydrocarbon well regarding the value of the sensed parameter within the subsurface region and/or to provide the operator of the hydrocarbon well with information regarding the status of the hydrocarbon well, at least as such status relates to the value of the sensed parameter. The conveying at 235 may be at least partially responsive to and/or a result of the generating at 230. As such, the conveying at 235 may be performed subsequent to, or subsequent to each instance of, the generating at 230. Stated another way, the conveying at 235 may be utilized to convey each sensor signal generated during the generating at 230.

The conveying at 235 may be accomplished in any suitable manner. As an example, and as discussed in more detail herein, the hydrocarbon well may include a plurality of downhole plugs that may be positioned within the tubular conduit and/or spaced-apart along a length of the tubular conduit. In this example, the conveying at 235 may include conveying the sensor signal at least partially via plug-to-plug communication among the plurality of downhole plugs. Such plug-to-plug communication may be accomplished in any suitable manner, such as utilizing a corresponding communication device of each downhole plug. Examples of the corresponding communication device are disclosed herein with reference to communication device 140 of FIG. 2.

As another example, the hydrocarbon well may include a downhole communication network, an example of which is disclosed herein with reference to downhole communication network 90 of FIG. 1. In this example, the conveying at 235 may be performed at least partially with, via, and/or utilizing the downhole communication network.

In a variation on the above examples, at least one downhole plug may form a portion, or a communication node, of the downhole communication network. In this variation, the downhole communication network may include at least one other communication node that is not a downhole plug, that is distinct from the at least one downhole plug, and/or that is spaced-apart from the at least one downhole plug.

Utilizing the sensor signal at 240 may include utilizing the sensor signal in any suitable manner and/or making any suitable decision based, at least in part, on the sensed parameter and/or on the value of the sensed parameter. As an example, the utilizing at 240 may include utilizing the sensor signal to recreate, to determine, to calculate, and/or to estimate the sensed parameter and/or the value of the sensed parameter. As another example, the utilizing at 240 may include monitoring the value of the sensed parameter and/or displaying the sensed parameter and/or the value of the sensed parameter to the operator of the hydrocarbon well. As additional examples, the utilizing at 240 may include directing the operator of the hydrocarbon well to remove the downhole plug from the tubular conduit, informing the operator of the hydrocarbon well of a location of the downhole plug within the tubular conduit, informing the operator of the hydrocarbon well that the downhole plug currently is being removed from the tubular conduit, (such as via milling and/or dissolution), and/or informing the operator of the hydrocarbon well of motion of the downhole plug within the tubular conduit during a completion operation of the hydrocarbon well that utilizes the downhole plug, (such as may be indicative of failure of the fluid seal). As another example, the utilizing at 240 may include determining a seal integrity of the fluid seal.

In a more specific example, and as discussed, the sensed parameter may include, may be, and/or may be indicative of formation of a downhole obstruction within the tubular conduit and/or proximate the downhole plug. In this example, the utilizing at 240 may include performing the releasing at 250 at least partially responsive to formation of the downhole obstruction within the tubular conduit.

In another more specific example, and as discussed, the sensed parameter may include, may be, and/or may be indicative of the temperature proximate the downhole plug and/or within the tubular conduit. In this example, the utilizing at 240 may include informing the operator of the hydrocarbon well regarding the temperature within the tubular conduit, regarding the temperature within the tubular conduit as a function of time, and/or regarding the temperature within the tubular conduit as a function of position within the tubular conduit.

In another more specific example, and as discussed, the sensed parameter may include, may be, and/or may be indicative of a pressure proximate the downhole plug and/or within the tubular conduit. In this example, the utilizing at 240 may include determining a position, or a depth, of the downhole plug within the tubular conduit and/or within the subsurface region based, at least in part, on the pressure.

In another more specific example, and as discussed, the sensed parameter may include, may be, and/or may be indicative of a differential pressure between the uphole end of the downhole plug and the downhole end of the downhole plug. In this example, the utilizing at 240 may include determining that the fluid seal is intact responsive to the pressure differential being greater than a threshold pressure differential and/or determining that the fluid seal has failed responsive to the pressure differential being less than the threshold pressure differential.

In another more specific example, and as discussed, the sensed parameter may include, may be, and/or may be indicative of acceleration and/or motion of the downhole plug within the tubular conduit. In this example, the utilizing at 240 may include determining a position of the downhole plug within the tubular conduit based, at least in part, on the acceleration and/or motion of the downhole plug during a time period in which the downhole plug is positioned within the tubular conduit. Additionally or alternatively, the utilizing at 240 may include determining that the fluid seal has failed and/or that the plug has failed responsive to detection of acceleration and/or motion of the downhole plug during a time period in which the downhole plug is operatively engaged with the downhole tubular. Additionally or alternatively, the utilizing at 240 may include verifying that the downhole plug has successfully been released from operatively engagement with the downhole tubular during the releasing at 250. For example, the verifying may be, or may be responsive to, detection of acceleration and/or motion of the downhole plug subsequent to performing the releasing at 250.

In another more specific example, and as discussed, the sensed parameter may include, may be, and/or may be indicative of motion of the downhole plug past a collar of the downhole tubular. In this example, the utilizing at 240 may include determining the position of the downhole plug within the tubular conduit based, at least in part, on motion of the downhole plug past the collar during the time period in which the downhole plug is positioned within the tubular conduit. Additionally or alternatively, the utilizing at 240 may include determining that the fluid seal has failed and/or that the plug has failed responsive to motion of the downhole plug past the collar during the time period in which the downhole plug is operatively engaged with the downhole tubular. Additionally or alternatively, the utilizing at 240 may include verifying that the downhole plug has successfully been released from operatively engagement with the downhole tubular during the releasing at 250, such as responsive to motion of the downhole plug past the collar subsequent to performing the releasing at 250.

In another more specific example, and as discussed, the sensed parameter may include, may be, and/or may be indicative of a velocity of fluid flow past the downhole plug and/or within the tubular conduit. In this example, the utilizing at 240 may include determining that the seal has failed responsive to detection of a nonzero fluid flow velocity past the downhole plug during the time period in which the downhole plug is operatively engaged with the downhole tubular.

In another more specific example, and as discussed, the sensed parameter may include, may be, and/or may be indicative of a flow rate of fluid flow past the downhole plug and/or within the tubular conduit. In this example, the utilizing at 240 may include determining that the seal has failed responsive to detection of a nonzero flow rate of fluid past the downhole plug during the time period in which the downhole plug is operatively engaged with the downhole tubular.

In another more specific example, and as discussed, the sensed parameter may include, may be, and/or may be indicative of a density of fluid and/or of material that is proximal to and/or that contacts the sensor. In this example, the utilizing at 240 may include determining a fluid phase (e.g., liquid or gas) of the fluid that is proximal to the sensor and/or indicating the presence of solids, such as sand, proximal to the sensor.

In another more specific example, and as discussed, the sensed parameter may include, may be, and/or may be indicative of a capacitance and/or an electrical conductance of fluid that is proximal to and/or that contacts the sensor. In this example, the utilizing at 240 may include determining and/or estimating an identity of the fluid that is proximal to the sensor (e.g., hydrocarbon fluid or water).

In another example, and as discussed, the hydrocarbon well may include a plurality of downhole plugs that may be configured for plug-to-plug communication. In this example, the utilizing at 240 may include determining a relative location of each downhole plug of the plurality of plugs within the tubular conduit and/or based, at least in part, on the conveying at 235. Stated another way, knowledge of which downhole plug(s) receive the sensor signal from which other plug(s) and/or of a signal transmission time between adjacent plugs may be utilized to determine, to establish, and/or to estimate an order of the plurality of plugs within the tubular conduit and/or a distance between adjacent plugs of the plurality of plugs.

Releasing the tracer at 245 may include releasing the tracer from the downhole plug. Examples of the tracer are disclosed herein with reference to tracer 152 of FIGS. 1-2. The releasing at 245 may be accomplished in any suitable manner. As an example, a tracer release structure, such as tracer release structure 150 of FIG. 2, may be utilized to perform the releasing at 245. Similarly, the releasing at 245 may be performed and/or initiated based upon and/or responsive to any suitable criteria. As examples, the releasing at 245 may be performed and/or initiated at least partially responsive to the sensed parameter being within a predetermined sensed parameter range, formation of a downhole obstruction within the tubular conduit and proximate the downhole plug, expiration of a predetermined tracer release time interval, and/or destruction of the downhole plug.

When methods 200 include the releasing at 245, methods 200 further may include detecting the tracer, such as with a tracer detection structure of the hydrocarbon well. Examples of the tracer detection structure are disclosed herein with reference to tracer detection structure 60 of FIG. 1.

Releasing the downhole plug from engagement with the downhole tubular at 250 may include ceasing operative engagement between the downhole plug and the downhole tubular, permitting motion of the downhole plug within the tubular conduit, and/or permitting fluid flow within the tubular conduit and past the downhole plug.

The releasing at 250 may be performed in any suitable manner. As examples, the releasing at 250 may include at least partially destroying the downhole plug via a self-destruct mechanism of the downhole plug, imploding the downhole plug, at least partially dissolving the downhole plug, and/or operatively disengaging the downhole plug from the downhole tubular.

The releasing at 250 may be performed and/or initiated based upon and/or responsive to any suitable criteria, including those that are discussed herein. As additional examples, the releasing at 250 may be performed at least partially responsive to the sensed parameter being within a predetermined sensed parameter range, formation of a downhole obstruction within the tubular conduit and proximate the downhole plug, expiration of a predetermined downhole plug release time interval, and/or receipt of a release signal by the downhole plug.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, "at least substantially," when modifying a degree or relationship, may include not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are within 75% of the second length and also includes first lengths that are as long as the second length.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A downhole plug configured to be positioned within a tubular conduit of a downhole tubular of a hydrocarbon well when the downhole tubular extends within a wellbore that extends within a subsurface region, the downhole plug comprising:

a sealing structure;

an actuation mechanism configured to selectively transition the sealing structure between a disengaged state, in which the downhole plug is free to move within the tubular conduit, and an engaged state, in which the sealing structure operatively engages with the downhole tubular, forms a fluid seal with the downhole tubular, and resists motion of the downhole plug within the tubular conduit;

a sensor configured to detect a sensed parameter within the tubular conduit and generate a sensor signal indicative of the sensed parameter, wherein the sensor includes a downhole obstruction detection structure and the sensed parameter includes detection of the formation of a downhole obstruction proximate the downhole plug when the sealing structure is in the engaged state; and a release mechanism that selectively releases the downhole plug from the engaged state when the formation of the downhole obstruction proximate the downhole plug is detected and reaches a predetermined sensed parameter range.

2. The downhole plug of claim 1, wherein the downhole obstruction detection structure includes an infrared downhole obstruction detection sensor configured to detect an infrared signature indicative of the formation of the downhole obstruction within the tubular conduit and proximate the downhole plug.

3. The downhole plug of claim 1, wherein the downhole obstruction detection structure includes a piezoelectric downhole obstruction detection sensor configured to detect mechanical contact between the downhole obstruction and the downhole plug.

4. The downhole plug of claim 1, wherein the downhole obstruction detection structure includes a microelectromechanical system downhole obstruction detection sensor configured to detect the formation of the downhole obstruction within the tubular conduit and proximate the downhole plug.

5. The downhole plug of claim 1, wherein the downhole obstruction detection structure includes an ultrasonic downhole obstruction detection sensor configured to detect an ultrasonic signature indicative of the formation of the downhole obstruction within the tubular conduit and proximate the downhole plug.

6. The downhole plug of claim 1, wherein the downhole obstruction detection structure includes a strain gauge downhole obstruction detection sensor configured to detect mechanical strain applied to the downhole plug by the downhole obstruction.

7. The downhole plug of claim 1, wherein the sensor further includes at least one of:

(i) a temperature sensor, wherein the sensed parameter further includes a temperature proximate the downhole plug and within the tubular conduit;

(ii) a pressure sensor, wherein the sensed parameter further includes a pressure proximate the downhole plug and within the tubular conduit;

(iii) a differential pressure sensor, wherein the sensed parameter further includes a pressure differential between an uphole end of the downhole plug and a downhole end of the downhole plug;

(iv) an accelerometer, wherein the sensed parameter further includes acceleration of the downhole plug within the tubular conduit;

(v) a collar locator, wherein the sensed parameter further includes motion of the downhole plug past a collar of the downhole tubular;

(vi) a velocimeter, wherein the sensed parameter further includes a velocity of fluid flow past the downhole plug within the tubular conduit; and (vii) a flow sensor, wherein the sensed parameter further includes a flow rate of fluid past the downhole plug within the tubular conduit.

8. The downhole plug of claim 1, wherein the downhole plug includes a communication device configured to facilitate communication between the downhole plug and another structure of the hydrocarbon well.

9. The downhole plug of claim 8, wherein the communication device is configured to transmit the sensor signal.

10. The downhole plug of claim 8, wherein the communication device is configured to receive a received signal from another downhole plug of the hydrocarbon well, wherein the communication device is configured to transmit the received signal to yet another downhole plug of the hydrocarbon well.

11. The downhole plug of claim 1, wherein the downhole plug further includes a tracer release structure configured to selectively release a tracer from the downhole plug.

12. The downhole plug of claim 1, wherein the release mechanism is further configured to at least one of:

(i) selectively release the downhole plug at least partially responsive to expiration of a predetermined downhole plug release time interval; and (ii) selectively release the downhole plug at least partially responsive to receipt of a release signal.

13. A hydrocarbon well, comprising:

a wellbore that extends within a subsurface region;

a downhole tubular that extends within the wellbore and defines a tubular conduit; and the downhole plug of claim 1 positioned within the tubular conduit.

14. The downhole plug of claim 1, further comprising a communication device included in the downhole plug and programmed to convey the sensor signal to a surface region to inform an operator that the downhole plug is released from the tubular conduit when the formation of the downhole obstruction proximate the downhole plug reaches the predetermined sensed parameter range.

15. The downhole plug of claim 1, wherein the downhole plug further includes a tracer releasable from the downhole plug, the tracer including a memory that stores data related to the sensed parameter and readable at a surface region.

16. A method of operating a hydrocarbon well, the method comprising:

sensing, with a sensor of a downhole plug, a sensed parameter, wherein the downhole plug is positioned within a tubular conduit of a downhole tubular of the hydrocarbon well and the downhole tubular extends within a subsurface region, and wherein the sensor includes a downhole obstruction detection structure;

generating a sensor signal indicative of the sensed parameter with the sensor, wherein the sensed parameter includes detection of the formation of a downhole obstruction proximate the downhole plug when the sealing structure is in an engaged state; and releasing the downhole plug from the tubular conduit when the formation of the downhole obstruction proximate the downhole plug is detected and reaches a predetermined sensed parameter range.

17. The method of claim 16, wherein at least one of:

(i) the sensed parameter further includes a temperature proximate the downhole plug and within the tubular conduit;

(ii) the sensed parameter further includes a pressure proximate the downhole plug and within the tubular conduit, wherein the method further includes determining a position of the downhole plug within the tubular conduit based, at least in part, on the pressure;

(iii) the sensed parameter further includes a pressure differential between an uphole end of the downhole plug and a downhole end of the downhole plug;

(iv) the sensed parameter further includes acceleration of the downhole plug within the tubular conduit;

(v) the sensed parameter further includes motion of the downhole plug past a casing collar of the downhole tubular;

(vi) the sensed parameter further includes a velocity of fluid flow past the downhole plug within the tubular conduit; and (vii) the sensed parameter further includes a flow rate of fluid past the downhole plug within the tubular conduit, the method further comprising releasing the downhole plug from the tubular conduit when the sensed parameter of any of (i)-(vii) reaches a predetermined sensed parameter range.

18. The method of claim 16, wherein the hydrocarbon well includes a plurality of downhole plugs positioned within the tubular conduit, and further wherein the conveying the sensor signal includes conveying the sensor signal at least partially via plug-to-plug communication among the plurality of downhole plugs.

19. The method of claim 18, wherein the method further includes determining a relative location of each downhole plug of the plurality of downhole plugs, within the tubular conduit, based, at least in part, on the conveying the sensor signal at least partially via plug-to-plug communication among the plurality of downhole plugs.

20. The method of claim 16, wherein the method further includes utilizing the sensor signal to at least one of:

(i) monitor a value of the sensed parameter;

(ii) direct the operator of the hydrocarbon well to remove the downhole plug from the tubular conduit;

(iii) inform the operator of the hydrocarbon well of a location of the downhole plug within the tubular conduit; and (iv) inform the operator of the hydrocarbon well of motion of the downhole plug within the tubular conduit during a completion operation of the hydrocarbon well that utilizes the downhole plug.

21. The method of claim 16, wherein the method further includes releasing a tracer from the downhole plug.

22. The method of claim 21, wherein the releasing the tracer is at least partially responsive to at least one of:

(i) the sensed parameter being within the predetermined sensed parameter range;

(ii) the formation of the downhole obstruction within the tubular conduit and proximate the downhole plug;

(iii) expiration of a predetermined tracer release time interval; and (iv) destruction of the downhole plug.

23. The method of claim 16, wherein, prior to the sensing and the generating, the method includes operatively engaging the downhole plug with the downhole tubular to form a fluid seal between the downhole plug and the downhole tubular and to resist motion of the downhole plug within the tubular conduit.

24. The method of claim 16, wherein the releasing the downhole plug further includes releasing at least partially responsive to at least one of:

(i) expiration of a predetermined downhole plug release time interval; and (ii) receipt of a release signal.

* * * * *